US008567099B2

(12) United States Patent
Bai et al.

(10) Patent No.: US 8,567,099 B2
(45) Date of Patent: Oct. 29, 2013

(54) DEVICE TO DRY CATALYST ROASTER CONVEYOR BELT AND METHOD OF USING SAME

(75) Inventors: Hua Bai, Lake Jackson, TX (US); Ralph S. Kruska, Houston, TX (US)

(73) Assignee: Dow Technology Investments LLC, Midland, MI (US)

( * ) Notice: Subject to any disclaimer, the term of this patent is extended or adjusted under 35 U.S.C. 154(b) by 441 days.

(21) Appl. No.: 12/912,233

(22) Filed: Oct. 26, 2010

(65) Prior Publication Data

US 2011/0094120 A1 Apr. 28, 2011

Related U.S. Application Data

(60) Provisional application No. 61/255,591, filed on Oct. 28, 2009.

(51) Int. Cl.
*F26B 13/00* (2006.01)

(52) U.S. Cl.
USPC ..... 37/387; 34/487; 34/507; 34/611; 34/619; 432/233; 432/238; 502/209; 502/353; 219/388; 374/209; 427/378

(58) Field of Classification Search
USPC ..... 34/90, 381, 384, 387, 451, 487, 507, 34/510, 611, 619, 623; 432/1, 233, 238; 502/209, 353; 219/388, 494; 374/208, 374/209; 427/377, 378
See application file for complete search history.

(56) References Cited

U.S. PATENT DOCUMENTS 1,982,756 A * 12/1934 Roesen ..... 34/103
3,437,605 A 4/1969 Keith (Continued)

FOREIGN PATENT DOCUMENTS

DE 1299667 B 1/1965
DE 10301738 A1 * 7/2004

(Continued)

OTHER PUBLICATIONS

International Search Report dated Mar. 10, 2011 for International Application No. PCT/US2010/054091.

(Continued)

*Primary Examiner* — Steve M Gravini
(74) *Attorney, Agent, or Firm* — Cantor Colburn LLP

(57) ABSTRACT

A system and process for removing an inorganic salt from a catalyst roaster belt is disclosed. The system includes an apparatus with a drying vessel having a catalyst roaster belt inlet, a catalyst roaster belt outlet, a heating medium inlet, and a heating medium outlet, wherein the catalyst roaster belt inlet and the catalyst roaster belt outlet are spaced apart along a first direction, the heating medium inlet and the heating medium outlet are spaced apart along a second direction, the heating medium inlet is spaced apart from the catalyst roaster belt inlet in the second direction, and the catalyst roaster belt inlet is between the heating medium inlet and the heating medium outlet along the second direction. The system includes an acid bath and a moveable catalyst roaster belt extending from the acid bath through the catalyst roaster belt inlet and through the catalyst roaster belt outlet. The process includes the steps of providing a catalyst roaster belt with an inorganic salt disposed thereon and supplying a heating medium to a first side of the catalyst roaster belt such that heat from the heating medium flows through the catalyst roaster belt to a second side of the catalyst roaster belt to vaporize the inorganic salt.

20 Claims, 4 Drawing Sheets

(56) References Cited

U.S. PATENT DOCUMENTS

| | | | | | |
|---|---|---|---|---|---|
| 3,849,904 | A | * | 11/1974 | Villalobos | 34/636 |
| 3,909,953 | A | | 10/1975 | Hemsath et al. | |
| 3,913,241 | A | | 10/1975 | Chaikin et al. | |
| 4,107,378 | A | * | 8/1978 | Bourguignon et al. | 428/323 |
| 4,135,308 | A | * | 1/1979 | Benson | 34/344 |
| 4,248,741 | A | | 2/1981 | Wernli et al. | |
| 4,365,423 | A | * | 12/1982 | Arter et al. | 34/463 |
| 4,472,624 | A | | 9/1984 | Janning | |
| 4,538,899 | A | * | 9/1985 | Landa et al. | 399/156 |
| 4,696,115 | A | * | 9/1987 | Spadafora | 34/524 |
| 4,715,912 | A | * | 12/1987 | Tillotson | 156/79 |
| 4,825,561 | A | | 5/1989 | Cornell | |
| 4,916,243 | A | | 4/1990 | Bhasin et al. | |
| 4,984,594 | A | | 1/1991 | Vinegar et al. | |
| 5,008,413 | A | | 4/1991 | Liu | |
| 5,024,319 | A | | 6/1991 | Dixon et al. | |
| 5,071,540 | A | * | 12/1991 | Culross et al. | 208/414 |
| 5,270,519 | A | | 12/1993 | Higgins | |
| 5,343,632 | A | * | 9/1994 | Dinh | 34/507 |
| 5,553,189 | A | | 9/1996 | Stegemeier et al. | |
| 5,600,899 | A | | 2/1997 | Stevens et al. | |
| 5,641,722 | A | * | 6/1997 | Mitchell et al. | 502/209 |
| 5,651,191 | A | * | 7/1997 | Walunas et al. | 34/236 |
| 5,680,713 | A | * | 10/1997 | Forbert et al. | 34/342 |
| 5,881,476 | A | | 3/1999 | Strobush et al. | |
| 5,967,770 | A | * | 10/1999 | Heine et al. | 432/59 |
| 6,157,002 | A | | 12/2000 | Schjerven, Sr. et al. | |
| 6,184,175 | B1 | * | 2/2001 | Rizkalla | 502/347 |
| 6,589,417 | B2 | | 7/2003 | Taciuk et al. | |
| 6,735,882 | B2 | * | 5/2004 | Takahashi | 34/212 |
| 7,214,903 | B2 | | 5/2007 | Curatolo | |
| 7,401,417 | B2 | | 7/2008 | Rydell et al. | |
| 7,410,104 | B2 | | 8/2008 | MacPherson | |
| 7,432,483 | B2 | | 10/2008 | Wilson | |
| 2004/0025366 | A1 | * | 2/2004 | Soucy | 34/230 |
| 2007/0023413 | A1 | | 2/2007 | Wilson | |
| 2011/0094120 | A1 | * | 4/2011 | Bai et al. | 34/90 |

FOREIGN PATENT DOCUMENTS

| | | | | |
|---|---|---|---|---|
| JP | 07165932 | A | * | 6/1995 |
| JP | 2003066732 | A | * | 3/2003 |
| WO | WO 9604989 | A1 | * | 2/1996 |
| WO | WO 2007104268 | A1 | * | 9/2007 |

OTHER PUBLICATIONS

Written Opinion of the International Searching Authority mailed Mar. 10, 2011 for International Application No. PCT/US2010/054091.

EP Office Action for International Application No. 10776003.5, dated Apr. 23, 2013, 8 pages.

* cited by examiner

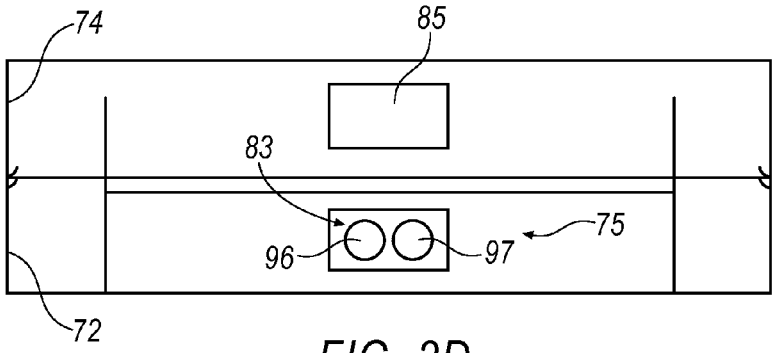
FIG. 2D
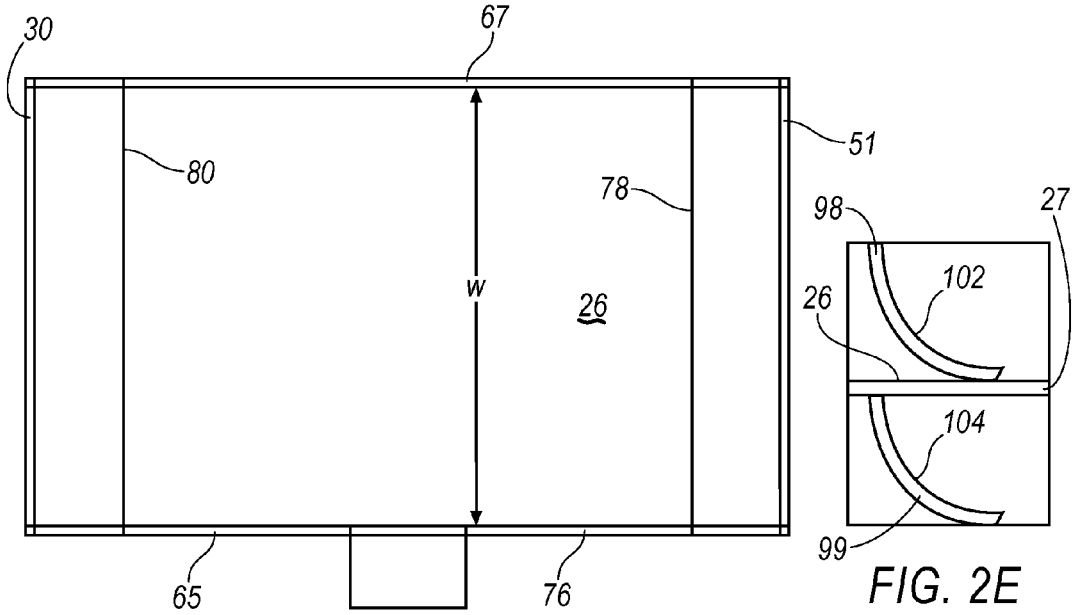
FIG. 2E
FIG. 2F

DEVICE TO DRY CATALYST ROASTER CONVEYOR BELT AND METHOD OF USING SAME

This application claims the benefit of U.S. Provisional Application No. 61/255,591, filed on Oct. 28, 2009, which is hereby incorporated by reference in its entirety.

TECHNICAL FIELD

This disclosure relates generally to an apparatus, system and process for vaporizing materials, such as, for example, inorganic salt catalysts from a catalyst roaster conveyer belt using a heat source such as, for example, hot air flow.

Alkylene oxides are known for a multiplicity of utilities. Ethylene oxide, for example, is used to produce ethylene glycol, nonionic surfactants, glycol ethers, ethanolamines, and polyethylene polyether polyols. Ethylene glycol is used as an automotive coolant, as antifreeze, and in preparing polyester fibers and resins. Propylene oxide is used to produce propylene glycol and polypropylene polyether polyols, which are used in polyurethane polymer applications.

Alkylene Oxides, such as, for example ethylene oxide and propylene oxide, are produced by oxidation of an olefin, such as ethylene or propylene, with oxygen at elevated temperature of about 250° over an inorganic catalyst comprising metallic silver supported on alumina. Typically, promoters such as chloride are also included. The production of ethylene oxide or propylene oxide catalyst occurs in an apparatus such as a catalyst roaster which typically includes an acid bath, usually containing nitric acid, to help clean the silver catalyst from the apparatus. The silver nitrate residue is passed through an air knife apparatus to blow the residue from the conveyor. It has been a challenge to manage the acid fumes generated in such a process, and it has been found that in some cases, the acid fumes escape to the interior of the industrial processing building, where they may pose a serious industrial hygiene and safety problem. Thus, a need has arisen for a process that addresses the foregoing issues.

SUMMARY

In accordance with one aspect, an apparatus for drying a catalyst roaster belt including a drying vessel having a catalyst roaster belt inlet, a catalyst roaster belt outlet, a heating medium inlet, and a heating medium outlet, wherein the catalyst roaster belt inlet and the catalyst roaster belt outlet are spaced apart along a first direction, the heating medium inlet and the heating medium outlet are spaced apart along a second direction, the heating medium inlet is spaced apart from the catalyst roaster belt inlet in the second direction, and the catalyst roaster belt inlet is disposed between the heating medium inlet and the heating medium outlet along the second direction is provided.

In another aspect, a system is provided for an apparatus as set forth above that includes an acid bath, and a moveable catalyst roaster belt extending from the acid bath through the catalyst roaster belt inlet and through the catalyst roaster belt outlet to vaporize inorganic salts from the conveyer belt.

In another aspect, a process is provided for removing an inorganic salt from a catalyst roaster belt in an apparatus as set forth above includes the steps of providing the catalyst roaster belt with the inorganic salt disposed thereon, wherein the catalyst roaster belt extends between the catalyst roaster belt inlet and the catalyst roaster belt outlet, and supplying a heating medium to a first side of the catalyst roaster belt such that the heating medium flows through the catalyst roaster belt to a second side of the catalyst roaster belt, and such that the inorganic salt is vaporized.

In yet another aspect, there is provided a process of removing a transition metal from a catalyst roaster belt, comprising the steps of passing the catalyst roaster belt through an acid bath to form a salt of the transition metal, removing liquid acid droplets from the catalyst roaster belt; and supplying a heating medium to a first side of the catalyst roaster belt such that the heating medium flows through the catalyst roaster belt to a second side of the catalyst roaster belt to vaporize the inorganic salt.

BRIEF DESCRIPTION OF THE DRAWINGS

FIG. 2D is a cross sectional view of the drying vessel through line A-A showing the construction of the air inlet and the air diffuser.

FIG. 2E is a magnified view showing the orientation of the air hooks and the belt.

FIG. 2F is a top view of the belt in the second zone showing the gap between the belt and the sidewalls of the drying vessel.

DETAILED DESCRIPTION

Figure 1:
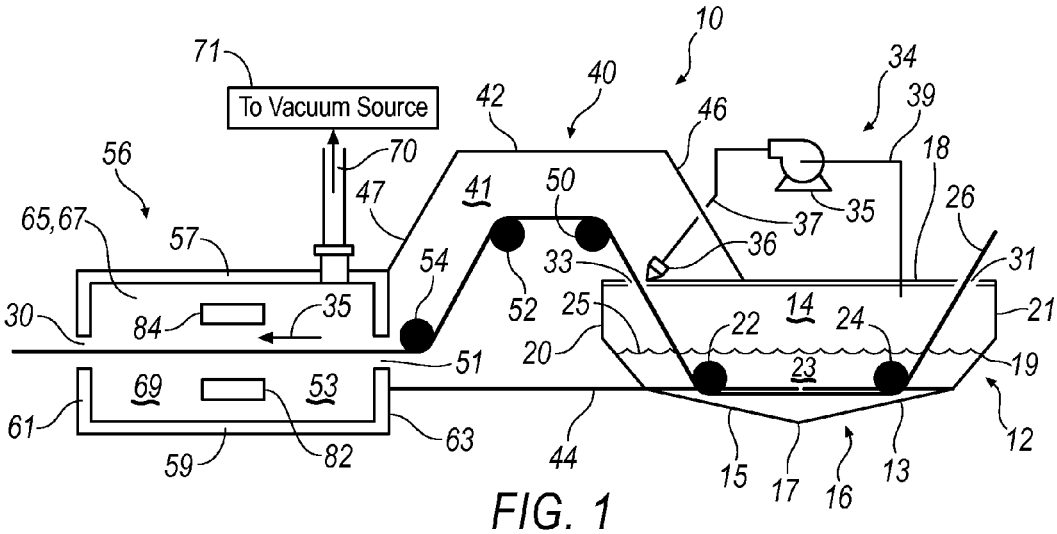
FIG. 1 is a schematic representation of an air knife system with a drying vessel to manage the generation of acid fumes according to one aspect of this disclosure.

Referring now to the drawings, illustrative embodiments are shown in detail. Although the drawings represent some embodiments, the drawings are not necessarily to scale and certain features may be exaggerated, removed, or partially sectioned to better illustrate and explain the present invention. Further, the embodiments set forth herein are exemplary and are not intended to be exhaustive or otherwise limit or restrict the claims to the precise forms and configurations shown in the drawings and disclosed in the following detailed description.

FIG. 1 is a schematic side view representation of an air knife system 10 with a drying vessel to manage the generation of acid fumes according to one aspect of this disclosure. The system includes acid bath 12 that includes a receptacle 14 having a bottom 16, which may consist of panels 13 and 15 joined at an obtuse angle 17 to form a compound bottom to the receptacle, a top 18 in spaced apart opposition to the bottom, and side wall 20 extending unbroken therebetween to define the receptacle. Each side wall may be comprised of panels 19 that extend at an obtuse angle from the panels 13 and 15, respectively, and joined to panel 21 at an obtuse angle to form the receptacle. The receptacle is constructed of some suitable material to contain an acid solution 23, such as nitric acid, that is useful as an acid cleaning system to remove inorganic salts such as a transition metal salt, and more particularly a nitrate salt such as, for example silver nitrate deposits or other catalyst deposits from the belt 26, which may be an ethylene oxide catalyst roaster belt as is known in the art. In one embodiment, the catalytic roaster belt may be constructed of a wire mesh that is resistant to the action of the acid solution. The receptacle is further equipped with rollers 22 and 24, preferably positioned under the level 25 of the acid bath, and oriented such that the belt passes through receptacle opening 31, then under the rollers and through the acid bath, and out of exit 33 in the direction of arrow 35, which represents a first direction. The rollers are made of a material resistant to the corrosive action of the acid solution.

An enclosure shroud 40 is positioned between the drying vessel or second hot zone 56 and the acid bath receptacle through which the belt must travel to get to the drying vessel. The shroud has a top 42 and bottom 44 in generally opposed spaced apart relation separated by sidewalls 46 and 47, and 49 and 43 to define a hollow space 41 through which the belt travels. The shroud is equipped with at least one, and preferably multiple rollers 50, 52 and 54 oriented in the shroud enclosure such that the belt travels into close proximity to air knife system 34 where the belt is subjected to a first phase of drying to begin removal of the warm dilute nitric acid bath solution. The shroud is a substantially sealed system to prevent the acid fumes escape to the interior of the industrial processing building Air knife system 34 may be utilized to remove acid solution from the belt. In one embodiment, it may consist of a blower mechanism 35 in fluid communication through conduit 37 with an air knife 36 through which it may supply air to blow over the belt as it passes in a first direction from the acid bath through the shroud. In this design aspect, the air knife may be constructed such that it has a thin slit across the whole width of the conveyer belt (thus the name of air knife) through which the air can pass at high velocity (more than 100 meter per second) and impact onto the roaster belt to assist in drying the belt of any residual nitric acid solution as it passes from the acid bath into the shroud area. The air knife system further includes a vent conduit 39 which directs introduced air from the acid bath back to the air knife blower in a manner to be hereinafter described.

As previously stated, the shroud is in substantially sealed relation relative to the interior of the industrial processing building where the system is installed. The drying vessel 56 is a hollow structure comprised of a top 57 and bottom 59 in opposed spaced apart relation separated by opposed exit wall 61 and entrance wall 63 and opposed side walls 65 and 67, to define an interior space 69. Roller 54 is advantageously positioned proximal to roaster belt entrance 51 in entrance wall 63 to assist in guiding the roaster belt into the interior space 69 of the drying vessel. The drying vessel is equipped with a vent 70 in fluid communication with a vacuum source 71 to vent acid fumes and vaporized inorganic salts from the system to a containment zone (not shown) to prevent the acid fumes from building up to any appreciable level in the area where the system is operating. The roaster belt between conduits 85 and 83 and through exit 30 as will be hereinafter described.

Having described one embodiment of the system as contemplated by this disclosure, FIGS. 2A through 2G describe one configuration of a drying vessel as contemplated by this disclosure. Specifically, the drying vessel may be equipped with a roaster belt inlet 51 and a roaster belt outlet 30 spaced apart in a first direction, and a heating medium inlet 72 and a heating medium outlet 74 in a side wall of the drying vessel, oriented in a second direction. The air inlet and the air outlet are oriented such that the perforated plate 76 lies between them and extends between inner walls (baffles) 78 and 80 of the drying vessel and the side walls 65 and 67 of the drying vessel. The belt passes in close proximity to the perforated plate along a first direction as it passes through the drying vessel. Accordingly, it can be understood that the heating medium inlet is spaced apart from the catalyst roaster belt inlet in the second direction and the catalyst roaster belt inlet is disposed between the heating medium inlet and the heating medium outlet along the second direction.

As can be seen in FIG. 2F, the belt 26 has a width that is slightly narrower than the perforated plate 76 to facilitate its passage through the drying vessel. In one embodiment, the belt provides a one inch clearance on either side of the perforated plate and the side walls 65, 67 of drying vessel. As seen in FIG. 2G, the perforated plate 76 is equipped with at least one, and preferably multiple, apertures 73 that permit hot medium, such as air or any other gas, at temperatures of about from about 450° C. to about 750° C., to be introduced through inlet 72 to pass through the apertures 73, contact the belt, dry the belt, and vaporize the inorganic salt catalyst residue on the belt. The apertures 73 are oriented and designed to provide optimal air flow therethrough to permit optimal drying of the roaster belt. It has been determined that at least 10 apertures, preferably 40-200 apertures, up to a maximum of about 500 apertures distributed uniformly are optimal for the configuration of this embodiment, and each aperture should have a diameter of from about 0.5 to about 5.0 inches. However, different numbers of apertures and different diameters of the apertures are contemplated and may be advantageous in other configurations of the system as described. Positioned along the perforated plate distant of the side walls 65 and 67 at least by twice of the clearance between the conveyer belt and the side walls to prevent flow short circuiting. The action of drying the roaster belt by exposing it to hot air causes the residual acid bath solution to be evaporated and drawn through the vent 70 by the vacuum source 71 to vent them out of a building as previously described. The system is constructed such that a very slight vacuum, e.g., less than 0.1 inches $H_2O$ column vacuum, can be utilized to draw the fumes from the evaporated residual nitric acid and vaporized inorganic salt catalyst out of the drying vessel and safely vent them.

Figure 2A:
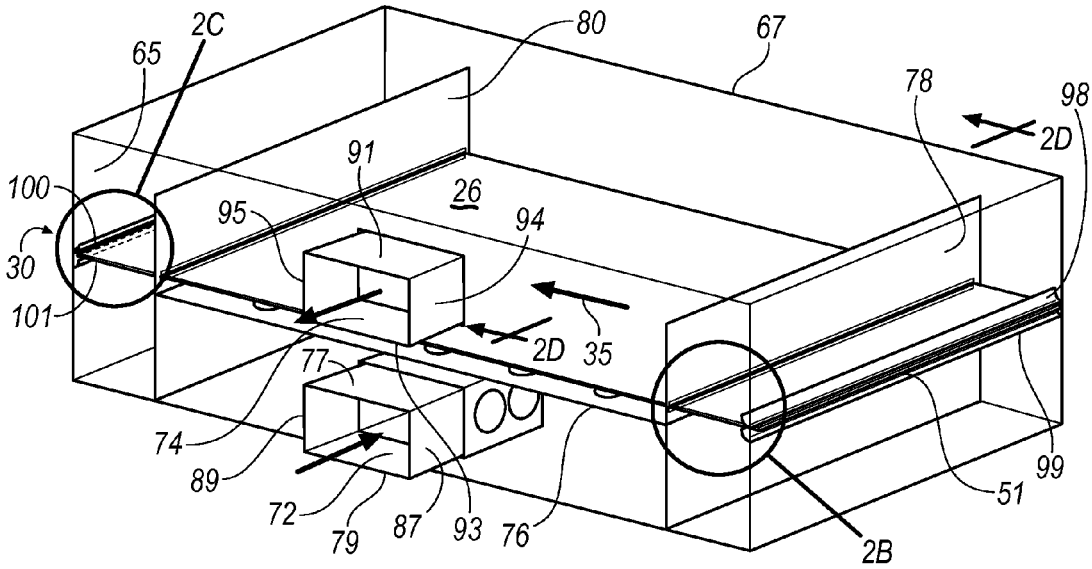
FIG. 2A is a perspective view of the drying vessel of FIG. 1.
Figure 2B:
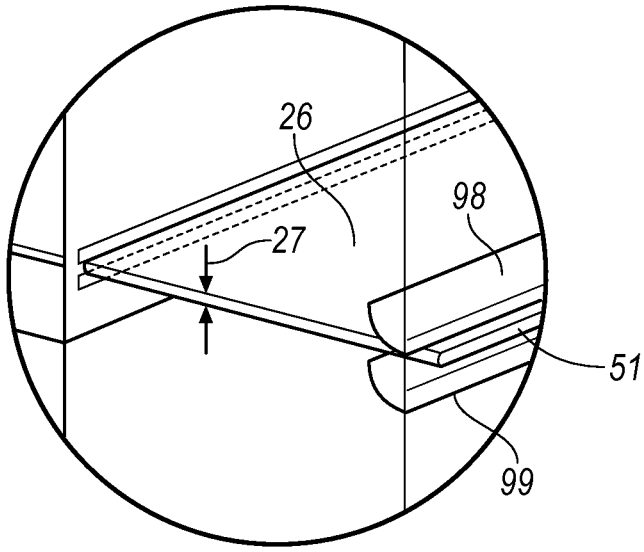
FIG. 2B is a detailed view of Section A of FIG. 2A showing the passage of the belt through the entrance of the drying vessel.
Figure 2C:
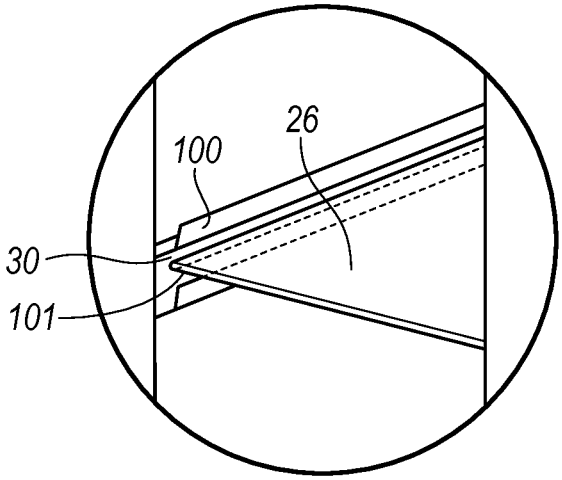
FIG. 2C is a detailed view of Section B of FIG. 2A showing the passage of the belt through the exit of the drying vessel.
Figure 2G:
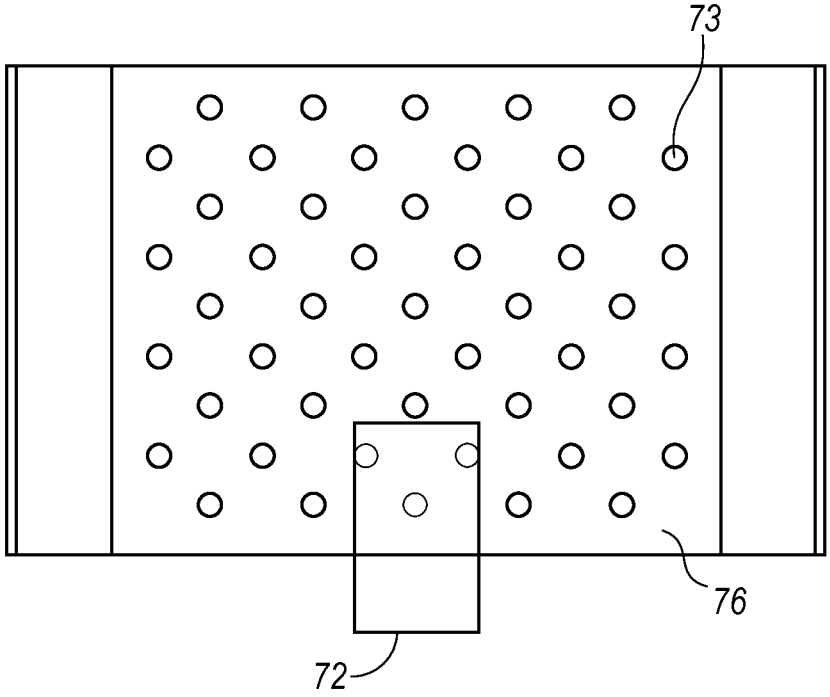
FIG. 2G is a detailed view of the perforated plate of the drying vessel showing its construction.

FIG. 2D is a side view of the heating medium inlet and heating medium outlet system 75 useful in one embodiment of this disclosure taken along D-D of FIG. 2A. Specifically, as seen in FIG. 2A, the heating medium inlet and outlet system may be comprised of conduits 82 and 84, respectively. The conduits extend in a second direction relative to the travel direction 35 of the belt, belt inlet and outlet. The heating medium inlet conduit is constructed to have top 77 and bottom 79 in opposed spaced apart relation relative to each other with sidewalls 87 and 89 extending therebetween to define the conduit. Similarly, the heating medium outlet conduit is constructed of top 91 and bottom 93 in opposed spaced apart relation separated by sidewalls 94 and 95 to define a conduit. Conduit 82, which functions as the heating medium inlet conduit, may further be equipped with baffles or an air diffuser 83 through which incoming heated air may be diffused through spaced apart apertures 96 and 97 into the interior of the drying vessel. The inlet conduit is adapted to accommodate an in flow of air that is sufficient to rapidly dry the roaster belt. In one embodiment, the inlet conduit can accommodate an in flow of air of about 4000 lbs/hr, and is constructed to withstand elevated temperatures of about 450° C. to about 750° C. or more. This temperature range serves to vaporize the inorganic salt catalyst. As previously stated, the in flow of air passes through the apertures in the perforated plate and the air passes through the roaster belt to vaporize residual acid bath solutions. The air outlet conduit 84 is equipped with at least one, and preferably several, air outlets 85 that accommodate the flow of air from the air inlet to ensure that the bariatric pressure in the drying vessel does not exceed the limitations of the structure of the drying vessel. The conduits are preferably of equal dimensions, and it has been determined that at least in one embodiment of the system, the air inlet baffle apertures 96 and 97 and the air outlet 85 are positioned approximately 16 inches on center from each other. Further, the conduits are each in spaced apart relation to the perforated plate and the roaster belt by a predetermined distance. In one embodiment, the inlet conduit top is spaced about 4 inches from the perforated plate and the outlet conduit is spaced about 4 inches from the catalytic roaster belt.

Turning back to FIG. 2A, it can be seen that the belt entrance 51 is equipped with air hooks 98 and 99, respectively, to direct the air draw-in from the entrance 51 over the belt. Similarly, belt exit 30 is equipped with air hooks 100 and 101, respectively, to direct the air draw-in from the exit 30 over the belt as it exists the drying vessel. The construction of the air hooks can be better understood with reference to FIG. 2B, which shows the air hooks as they are employed at the belt entrance, and FIG. 2C, which shows the air hooks as they are employed at the belt exit.

As the air hooks at either the belt inlet or the belt exit are the same, discussion will be made with reference to FIG. 2E. While the description is made relative to the air hooks associated with the air inlet entrance, it is understood that the same applies to all the air hooks used in the system. Top air hook 98 is separated from bottom air hook 99 by the catalytic roaster belt 26, which has a thickness 27. The hooks have a radiused profile 102 and 104, respectively, that may be identical. The radiused profiles are each oriented in the same direction such as the second direction, to direct the flow of air over the belt as it enters the drying vessel. Accordingly, whereas the air inlet entrance air hooks 98 and 99 are oriented in a first orientation, the air hooks at the air exit are oriented in the opposite orientation to direct the flow of air over the catalytic roaster belt as the air is drawn into the drying vessel.

Figure 3:
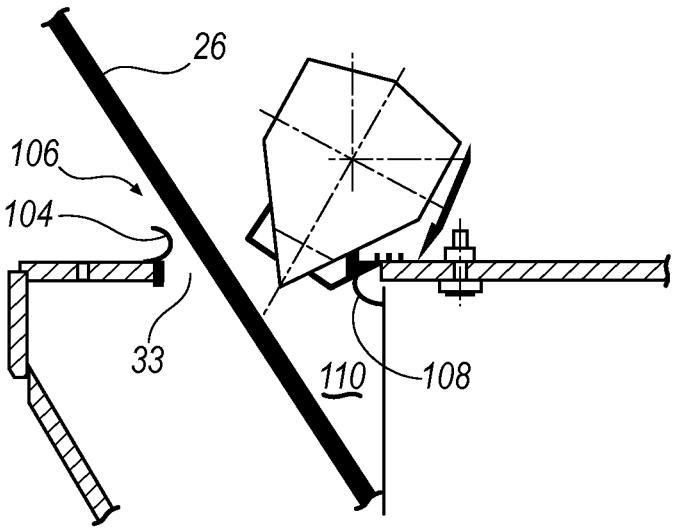
FIG. 3 is a detailed view of the air knife, showing its orientation relative to air hooks and the catalytic roaster belt.

As previously described the system includes an air knife system to direct forced air onto the roaster belt as it exits the acid bath. Reference will be made to FIG. 1 and FIG. 3 to explain the action of the air knife. Specifically, FIG. 3 is a detailed view of the air knife in close proximity to the roaster belt. The air knife is mounted onto the top of the acid bath adjacent to the belt exit 33. An air hook 104 is oriented on side 106 of the exit 33 to form an air foil seal between the belt 26 and the junction between the acid bath and the shroud. Another air hook 108 is positioned on side 110 of the exit 33 adjacent to the air knife to form a seal between the acid bath exit and the air knife. As the belt exits the acid bath, the air knife "power washes" the belt with high velocity air flow, forcing residual acid solution from the belt back into the acid bath receptacle. It may be understood that the action of the air knife may introduce additional air back into the acid bath receptacle. Accordingly, a vent conduit or suction 39 is in fluid communication between the air bath receptacle and the blower to ensure that introduced air into the bath is vented back through the blower and from there may be directed through the air knife to blow residual acid solution from the belt back into the acid bath receptacle.

Having thus described at least one embodiment of the system, it may be seen that in one aspect, the system can be used in a process for removing an inorganic salt from a catalyst roaster belt using the apparatus and system as described wherein the catalyst roaster belt has an inorganic salt disposed thereon, and wherein the catalyst roaster belt extends between the catalyst roaster belt inlet and the catalyst roaster belt outlet. The system can have heating medium at a first side of the catalyst roaster belt such that the heating medium flows through the catalyst roaster belt to a second side of the catalyst roaster belt, and such that the inorganic salt is vaporized.

In another embodiment, is contemplated that the process for removing an inorganic salt disposed on a catalytic roaster belt includes providing a catalyst roaster belt with the inorganic salt disposed thereon and supplying a heating medium to a first side of the catalyst roaster belt such that the heating medium flows through the catalyst roaster belt to a second side of the catalyst roaster belt, and such that the inorganic salt is vaporized. The catalytic belt may be moving in a first direction and the heated medium flows in a second direction. The first direction and the second direction may or may not be parallel to each other. The heating medium may be air, and the inorganic salt is a nitrate salt, and more specifically may be silver nitrate.

In another embodiment, the process may include an enclosure within which the catalyst roaster belt is partially disposed, and into which the heating medium flows. The enclosure operates at a pressure less than atmospheric pressure, and may preferably operate at no more than about 0.1 in. $H_2O$ column vacuum.

In another embodiment, there is contemplated a process for drying a catalytic roaster belt wherein the enclosure includes a catalyst roaster belt inlet, and the process further comprises receiving air through the catalyst roaster belt inlet and diverting the received air away from the catalyst roaster belt. When the heated medium is introduced into the interior of the drying vessel, it may flow in a plurality of directions in the interior of the enclosure before flowing through the catalyst roaster belt. In another embodiment, when the system has two baffles the heating medium comprises supplying the heating medium may be introduced to a first side of the catalyst roaster belt such that the heating medium flows between the baffles.

In another embodiment, the process of removing a transition metal from a catalyst roaster belt may comprise the steps of passing the catalyst roaster belt through an acid bath to form a salt of the transition metal such as silver nitrate, removing liquid acid droplets from the catalyst roaster belt such as forced air by impinging a gas stream on the catalyst roaster belt; and supplying a heating medium to a first side of the catalyst roaster belt such that the heating medium flows through the catalyst roaster belt to a second side of the catalyst roaster belt, and such that the inorganic salt is vaporized. The acid may be nitric acid, and the heating medium temperature is no less than about 450° C. and no greater than about 750° C.

The preceding description has been presented only to illustrate and describe exemplary embodiments of the methods and systems of the present invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. An apparatus for drying a catalyst roaster belt, comprising:

a drying vessel having a catalyst roaster belt inlet;

a catalyst roaster belt outlet;

a heating medium inlet; and a heating medium outlet;

wherein the catalyst roaster belt inlet and the catalyst roaster belt outlet are spaced apart along a first direction, the heating medium inlet and the heating medium outlet are spaced apart along a second direction, the heating medium inlet is spaced apart from the catalyst roaster belt inlet in the second direction, and the catalyst roaster belt inlet is between the heating medium inlet and the heating medium outlet along the second direction.

2. The apparatus of claim 1, wherein the catalyst roaster belt outlet is between the heating medium inlet and the heating medium outlet along the second direction.

3. The apparatus of claim 1, wherein the catalyst roaster belt comprises a mesh.

4. The apparatus of claim 1, comprising at least two baffles spaced apart along the first direction.

5. The apparatus of claim 4, wherein the heating medium inlet is disposed between the two baffles.

6. The apparatus of claim 1, further comprising a perforated plate between the heating medium inlet and the catalyst roaster belt inlet along the second direction.

7. The apparatus of claim 1, further comprising a heating medium inlet diffuser projecting into the interior of the drying vessel.

8. The apparatus of claim 1, further comprising a vent spaced apart from the heating medium inlet and the heating medium outlet along the second direction.

9. The apparatus of claim 1, wherein the drying vessel includes first and second sides spaced apart along a third direction, and the heating medium inlet and heating medium outlet are both located on the first side of the drying vessel.

10. The apparatus of claim 1, further comprising a heating medium flowable through the heating medium inlet.

11. The apparatus of claim 10 wherein the heating medium is a gas.

12. A system, comprising:

an acid bath;

the apparatus of claim 1; and a moveable catalyst roaster belt extending from the acid bath through the catalyst roaster belt inlet and through the catalyst roaster belt outlet.

13. A process for removing an inorganic salt from a catalyst roaster belt comprising:

providing the apparatus of claim 1;

providing a catalyst roaster belt with the inorganic salt disposed thereon, wherein the catalyst roaster belt extends between the catalyst roaster belt inlet and the catalyst roaster belt outlet;

supplying a heating medium to a first side of the catalyst roaster belt such that heat from the heating medium flows through the catalyst roaster belt to a second side of the catalyst roaster belt, and such that the inorganic salt is vaporized.

14. The process of claim 13, wherein the inorganic salt is a transition metal salt.

15. The process of claim 14, wherein the inorganic salt is silver nitrate.

16. A process of removing a transition metal from a catalyst roaster belt, comprising:

passing the catalyst roaster belt through an acid bath to form a salt of the transition metal;

removing liquid acid droplets from the catalyst roaster belt; and supplying a heating medium to a first side of the catalyst roaster belt such that heat from the heating medium flows through the catalyst roaster belt to a second side of the catalyst roaster belt, and such that the inorganic salt is vaporized.

17. The process of claim 16, wherein the acid is nitric acid.

18. The process of claim 16, wherein the heating medium temperature is no less than about 450° C.

19. The process of claim 16, wherein the heating medium temperature is no greater than about 750° C.

20. The process of claim 16, wherein the transition metal is silver.

* * * * *